US006453867B1

(12) United States Patent
Ruhland et al.

(10) Patent No.: US 6,453,867 B1
(45) Date of Patent: Sep. 24, 2002

(54) VALVE FOR COMBUSTION ENGINES

(75) Inventors: Helmut Hans Ruhland, Eschweiler (DE); Ulrich Bertram, Bergheim (DE)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/966,283

(22) Filed: Sep. 28, 2001

(30) Foreign Application Priority Data

Sep. 29, 2000 (DE) ..... 001214121

(51) Int. Cl.[7] ..... F02N 3/00
(52) U.S. Cl. ..... 123/188.3; 29/888.45
(58) Field of Search ..... 123/188.3; 29/888.45

(56) References Cited

U.S. PATENT DOCUMENTS 3,710,773 A * 1/1973 Piech et al. ..... 123/188 AA
4,169,488 A 10/1979 Goloff et al.
4,346,870 A * 8/1982 Chute et al. ..... 251/356
5,771,852 A 6/1998 Heimann, Jr. et al.

* cited by examiner

*Primary Examiner*—Tony M. Argenbright
*Assistant Examiner*—Katrina B. Harris

(57) ABSTRACT

A valve for an internal combustion engine has a valve stem, a valve cone and a valve disk, with the valve cone having a recess to receive the valve disk, and the valve cone and valve disk together forming a cavity. The valve disk has a lesser diameter than the recess in the valve cone, so that an insulation gap is formed between the recess in the valve cone and the valve disk edge. As a result the valve cone and valve stem are thermally insulated relative to the valve disk, which results in an advantageous, lower operating temperature at the valve cone. Particularly in the case of direct-injection internal combustion engines, this reduces the tendency to coking at the valve cone.

6 Claims, 1 Drawing Sheet

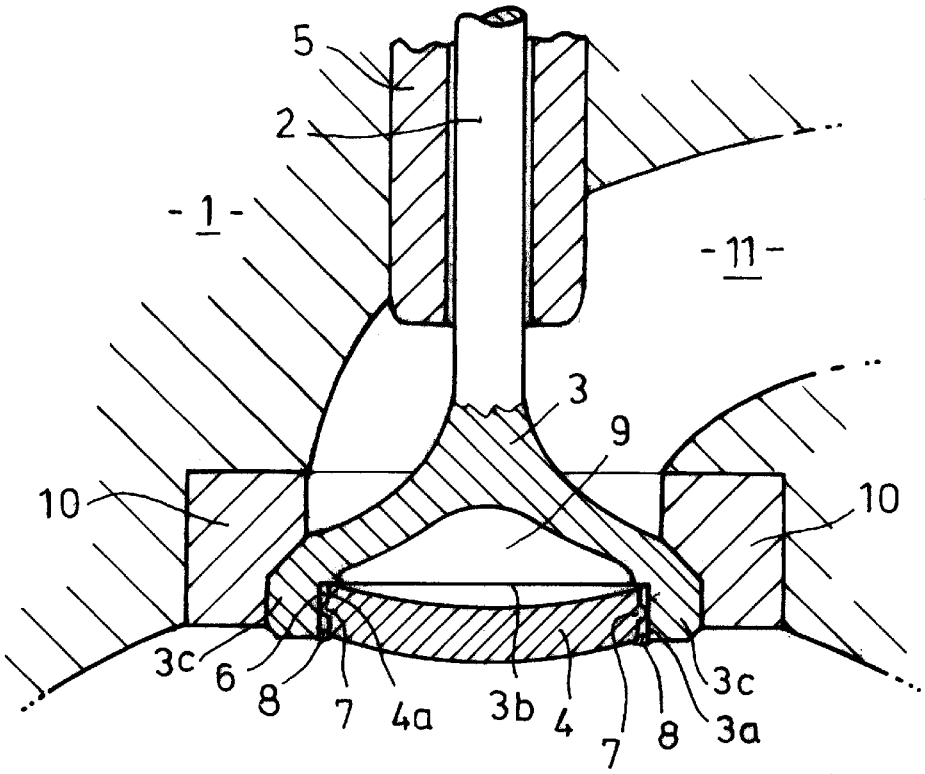
FIG. 1
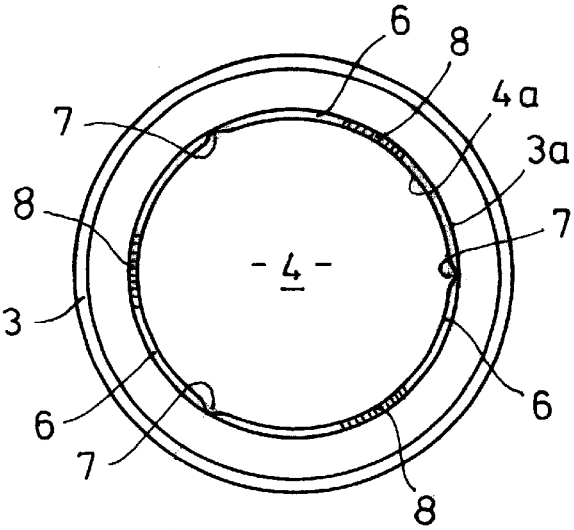
FIG. 2
FIG. 3
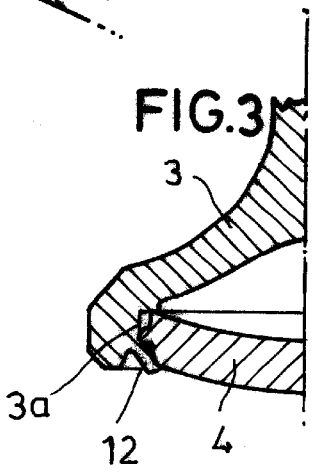
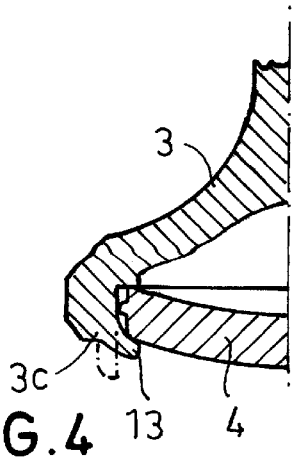
FIG. 4

VALVE FOR COMBUSTION ENGINES

BACKGROUND OF THE INVENTION

1. Field of the Invention

This invention relates to a valve, especially for internal combustion engines, in accordance with the preamble of Patent claim 1.

2. Disclosure Information

In engines in which fuel is not inducted via an intake manifold, or intake port, the valves disposed therein may coke very easily, which leads to a drastic deterioration in the performance and emission behavior.

The essential reason is that in engines with direct injection, unlike manifold injection engines, the inlet valves become considerably hotter, because the evaporative cooling of the fuel is absent. Small quantities of lubricating oil are always present on the valve stem, and these not only pass through the valve stem seal onto the valve stem during lubrication but are also passed via the crankcase breather system to the intake air in the form of oil mist and oil vapor and become deposited on the valve stem. In the case of engines with direct injection, unlike manifold injection engines, the lubricating oil is not washed off from the valve stem by the incoming fuel, so that in certain operating states of the engine the lubricating oil comes into contact with the hot valve cone, causes coking there and forms deposits that lead to loss of performance.

One solution to this problem is to cool the valve stem and valve cone sufficiently for the lubricating oil accumulating there not to cause coking.

A valve with liquid cooling is known from U.S. Pat. No. 4,169,488, in which the valve is designed to be hollow internally, with an internal second tube, whereby cooling liquid is passed through the valve stem to the valve cone and back. Such a valve is only suitable, however, for engines with very large valves, and, because such a valve is of complex construction, it is correspondingly elaborate and costly to produce.

U.S. Pat. No. 5,771,852 describes a valve having a hollow valve cone and valve stem, both of which are manufactured in one piece from a hollow tube. At the transition from the valve stem to the valve cone, elongate or curved indentations are disposed in the direction of the valve axis, these being intended first to increase the strength of the valve and secondly to cause swirling of the flow and hence improved removal of heat. A disadvantage here is that the introduction of heat into the valve cone through the valve disk is not prevented, and the valve cone thus undergoes a very high heat load, which is then only removed in the region of the indentations.

Accordingly, it is an object of the invention to design a valve such that it is simple to manufacture and remains cool in the region of the valve stem and the valve cone during operation, so that the lubricating oil present there does not cause coking.

This advantage is achieved, according to the invention, in that the valve disk has a lesser diameter than the recess in the valve cone, so that an insulation gap is formed between the recess in the valve cone and the valve disk edge.

The conduction of heat from the valve disk to the valve cone being interrupted by the insulation gap, the valve cone is subjected only to a fraction of the heat that would act upon it if there were a more rigorous connection to the valve disk, providing better conduction of heat. As the surface of the valve cone disposed directly in the combustion chamber represents only a narrow circle, the heat introduced into the valve cone via this surface can easily be removed via the valve seat.

The valve disk is exposed to the full heat load, because only small quantities of heat are removed via the structurally necessary contact with the valve cone. By a suitable choice of materials, both the heat resistance of the valve disk and the different heat expansion behavior of valve cone and valve disk can be adapted to the necessary operating conditions in the engine.

An advantageous embodiment of the valve envisages that a radially circumferential shoulder is disposed in the recess of the valve cone, on which shoulder the valve disk is supported in the direction of the valve axis. Such a shoulder is a practical way of passing into the valve seat, via the valve cone, the pressure forces arising as a result of the combustion pressure and acting on the valve disk. Such a shoulder also serves, during assembly of the valve, as a stop for the precisely axial positioning of the valve disk relative to the valve cone.

Advantageously, a plurality of shoulders distributed over the circumference are disposed in the recess of the valve cone, on which shoulders the valve disk is supported in the direction of the valve axis. This achieves the same functionality regarding force transmission and positioning as in the case of the circumferential shoulder, but the heat transmission is further reduced as a result of the smaller contact surface between valve disk and valve cone.

For the positive-fitting connection between valve cone and valve disk, the valve cone and valve disk comprise one or more joints at the circumference of the valve disk edge. In order to minimize the contact surfaces between valve cone and valve disk caused by the joints, and hence the heat transmission, the joints are disposed only in certain sections at the circumference of the valve disk edge. The joints may be produced by calking, welding or crimping onto the valve cone. Other joints are also possible, provided that the requirements in terms of strength and low heat transmission are met.

A further advantageous embodiment envisages that radial centering cams are disposed at the valve disk edge. These serve to center the valve disk in the recess during assembly. As a result of the centering, a constant insulation gap is ensured over the entire circumference of the valve disk edge.

A further embodiment envisages that radial centering cams are disposed in the recess of the valve cone. They perform the same function there as when disposed at the valve disk edge. A further advantage is that in the case of calking of valve cone and valve disk, these cams can simultaneously be used as calking material.

BRIEF DESCRIPTION OF THE DRAWINGS

Further advantageous embodiments and designs are to be found in the drawings, in which:

FIG. 1 shows a cross section through a valve according to the invention;

FIG. 2 shows the view of a valve from below, toward the valve disk;

FIG. 3 shows a cross section through a valve with calking; and

FIG. 4 shows a cross section through a valve with a crimped valve disk.

FIG. 1 shows the assembled valve in cylinder head 1. The valve comprises valve stem 2, valve cone 3 and valve disk 4. Valve stem 2 is displaceably mounted in the valve stem guide 5. At the bottom, the valve stem 2 makes a transition into the valve cone 3. In the drawing, the two are of one-piece design. It is not an impediment to the concept described if valve stem 2 and valve cone 3 are of two-part or multipart design (not shown here).

The valve cone has a recess 3*a*, in which the valve disk 4 is centrally disposed. Because the valve disk 4 is of lesser diameter than the recess 3*a*, insulation gap 6 is formed between recess 3*a* and the valve disk edge 4*a*. Centering in the radial direction is provided via a plurality of centering cams 7 disposed at the circumference of valve disk edge 4*a*. By means of the annular shoulder 3*b*, the valve disk 4 is positioned relative to the valve cone 3 in the axial direction of the valve. A plurality of spot welds 8 is disposed at the circumference of the valve disk edge 4*a* and form the joint between valve cone 3 and valve disk 4.

The heat transmission from the valve disk 4 to the valve cone 3 is determined by the contact surfaces between the two parts. Contact surfaces arise essentially at the spot welds 8, at the shoulder 3*b* of the valve cone 3 and at the centering cams 7. Otherwise, valve cone 3 and valve disk 4 are essentially thermally insulated by the insulation gap 6 and the cavity 9 formed between the two parts.

Whereas the valve disk 4 is fully exposed to the heat in the combustion chamber on the combustion chamber side, the valve cone 3 only undergoes a thermal stress in the annular flange 3*c* on the combustion chamber side. The low heat load resulting therefrom is almost completely removed via the valve seat 10. Additional cooling is undergone by the valve stem 2 and valve cone 3 as a result of the fresh-air feed in the inlet manifold 11.

FIG. 2 shows a view of the valve toward the valve disk 4. As a result of the centering cams 7, the valve disk is centrally disposed in the recess 3*a* of the valve cone 3. The insulation gap 6 runs around the entire circumference of the valve disk edge 4*a*. The three spot welds 8 represent the permanent connection between valve cone 3 and valve disk 4.

FIG. 3 shows show the valve disk 4 is joined to the valve cone 3 by calking 12. For this purpose, material is pressed at regular intervals by the valve cone 3 against the valve disk 4 at the circumference of the recess 3*a*. Calking is advantageous when high temperature differences exist between the two components. Because of the non-material connection between the two components, stress peaks are reduced by the displacement of the two components relative to one another with different degrees of heat expansion.

FIG. 4 shows how valve disk 4 and valve cone 3 are joined by crimping of material from the annular flange 3*c*. The annular bead 13 produced exhibits similar advantageous properties regarding thermal stresses to the calking 12.

The patent claims filed with the application are proposed formulations, without prejudice to the achievement of more extensive patent protection. The applicant reserves the right to claim further features hitherto disclosed only in the description and/or drawings.

The invention is not restricted to the example(s) of embodiment contained in the description. Many amendments and modifications are possible within the context of the invention, especially alternative embodiments, elements and combinations and/or materials which, for example, are inventive in that they combine or modify individual features and/or elements and process steps described in the general description and embodiments and in the claims and contained in the drawings, and lead by way of combinable features to new subject matter or new process steps or sequences of process steps, inter alia insofar as they relate to production, testing and working methods.

What is claimed is:

1. A valve, for an internal combustion engine, having a valve stem, a valve cone and a valve disk, the valve cone having a recess to receive the valve disk, and the valve cone and valve disk together forming a cavity, with the valve disk having a lesser diameter than the recess in the valve cone, so that an insulation gap is formed between the recess in the valve cone and the valve disk edge, with said valve disk having a plurality of radial centering cams disposed on the valve disk edge.

2. A valve according to claim 1, wherein valve cone and valve disk are connected by one or more joints at the circumference of the valve disk edge.

3. A valve according to claim 2, wherein said one or more joints are produced by welding.

4. A valve according to claim 2, wherein said one or more joints are produced by calking.

5. A valve, for an internal combustion engine, having a valve stem, a valve cone and a valve disk, the valve cone having a recess to receive the valve disk, and the valve cone and valve disk together forming a cavity, with the valve disk having a lesser diameter than the recess in the valve cone, so that an insulation gap is formed between the recess in the valve cone and the valve disk edge, wherein the valve cone and valve disk are connected by one or more joints at the circumference of the valve disk edge, with the joints being produced by crimping onto the valve cone.

6. A valve, for an internal combustion engine, having a valve stem, a valve cone and a valve disk, the valve cone having a recess to receive the valve disk, and the valve cone and valve disk together forming a cavity, with the valve disk having a lesser diameter than the recess in the valve cone, so that an insulation gap is formed between the recess in the valve cone and the valve disk edge, with said valve cone having a plurality of radial centering cams disposed in the recess of the valve cone.

* * * * *